US005307721A

United States Patent [19]

Ito

[11] Patent Number: 5,307,721

[45] Date of Patent: May 3, 1994

[54] VIOLIN

[76] Inventor: Shoichi Ito, No. 8, 2-chome, Yotsuya, Shinjuku-ku, Tokyo, Japan

[21] Appl. No.: 913,792

[22] Filed: Jul. 16, 1992

[30] Foreign Application Priority Data

Jan. 11, 1991 [JP] Japan ..... 3-313105
May 1, 1992 [JP] Japan ..... 4-137643

[51] Int. Cl.[5] ..... G10D 1/02
[52] U.S. Cl. ..... 84/277
[58] Field of Search ..... 84/274, 275, 277

[56] References Cited

U.S. PATENT DOCUMENTS 1,684,492 1/1927 Hultgren ..... 84/277
2,208,081 11/1937 Proebstel ..... 84/277
4,304,164 12/1981 Baker ..... 84/277

*Primary Examiner*—Richard A. Wintercorn
*Assistant Examiner*—P. Stanzione
*Attorney, Agent, or Firm*—Armstrong, Westerman, Hattori, McLeland & Naughton

[57] ABSTRACT

In a sound post of a musical instrument of a violin family, at least one end thereof is formed into a converged configuration. Most preferably, the sound post has a shape having a linear ridge line, and the sound post is placed in contact with the belly by a straight line in a direction substantially perpendicularly intersecting a direction of a bowstring.

9 Claims, 1 Drawing Sheet

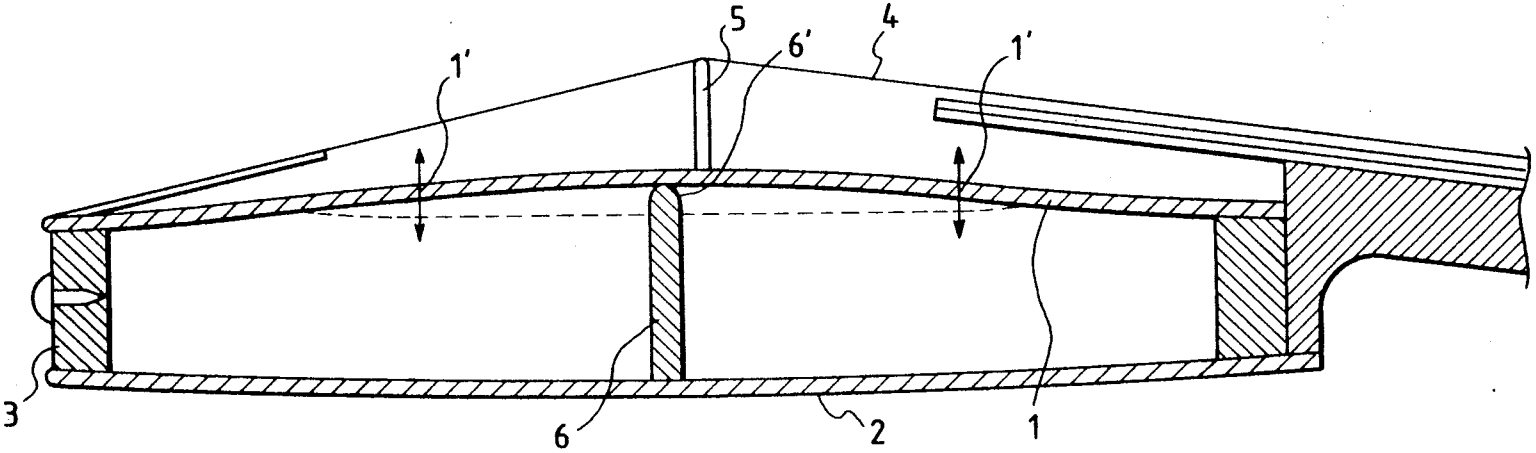
FIG. 1
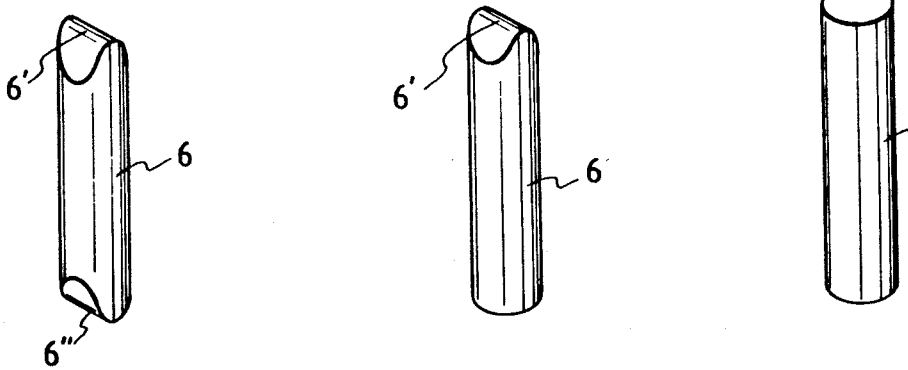
FIG. 2
FIG. 3
FIG. 4
PRIOR ART

VIOLIN

BACKGROUND OF THE INVENTION

1. Field of the Invention

This invention relates to an improvement in a violin and, more and particularly, to an improvement in a sound post thereof.

2. Description of the Prior Art

In the past, the body of a violin family is designed so that as shown in FIG. 1 which is a sectional view in a direction of a bowstring, in the lower surface of a belly 1 and the inside of the body, a bass bar extends parallel with a bowstring in the vicinity of a lower portion of a left leg of a bridge 5, and a sound post 6 is stood upright with opposite ends thereof placed in contact with the back plate 2 and the belly 1 in the vicinity of a portion at the rear of a right leg of the bridge 5. It has been known that the quality of a stress or rhythm of sound and a tone color is affected by the quality of the mounting of the bass bar and the sound post, and adjustment thereof is carefully carried out.

It has been heretofore considered that a part or role of the sound post 6 is to transmit a vibration of the bowstring or the belly 1 to the back plate 2 so as to induce a sounding of the whole body. The opposite ends of the sound post 6 formed from a small-diameter round pine rod are formed into a plane substantially vertical to the lengthwise direction of the rod and have to be placed in firm contact with both the back plate and the belly.

However, if the role of the sound post 6 is to transmit the vibration of the bowstring to the back plate, the position thereof is desirably located immediately under the bridge. The conventional interpretation of the role of the sound post is very questionable such that the vibration of the back plate does not seem to be so large in view of the fact that the sound post has to be stood upright away from the position of the bridge by about ¼ inches, and the belly 1 of the body is made of a relatively soft material such as a pine tree whereas the back plate 2 is made of a hard material such as a maple tree.

SUMMARY OF THE INVENTION

This invention is intended to provide a violin for which the volume and a tone color are improved by reviewing the role of the sound post.

For achieving the aforesaid object, a violin according to this invention is characterized in that at least one end of the sound post is formed to be convergent so that a contact surface thereof with the belly or the back plate is small. In order to reduce an area of the contact surface and to maintain the durability, it is desirable that one end of the sound post contacts with the belly or the back plate by a straight line in a direction perpendicularly intersecting a direction of a bowstring.

It is to be noted that the converged end of the sound post may be of the opposite ends of the sound post or only the end in contact with the belly.

BRIEF DESCRIPTION OF THE DRAWINGS

FIG. 1 is a sectional view of a violin according to this invention;

FIG. 2 is a perspective view showing one embodiment of a sound post according to this invention;

FIG. 3 is a perspective view of another embodiment of the sound post according to this invention;

FIG. 4 is a perspective view of a conventional sound post;

FIG. 5 is a perspective view of a third embodiment of the sound post according to this invention; and FIG. 6 is a perspective view of a fourth embodiment of the sound post according to this invention.

DETAILED DESCRIPTION OF THE PREFERRED EMBODIMENTS

Embodiments of a sound post used for a violin according to this invention will be described hereinbelow.

The body of a violin is shown in FIG. 1 in section. As is known, the peripheral portions of a belly 1 made of a pine material which is a relatively soft material and the back plate 2 made of a maple which is a hard material are fixedly adhered to the side plate 3. A bridge 5 for transmitting a vibration of a bowstring 4 to the belly 1 is placed on the upper surface of the surface plate 1, and on the lower surface thereof is fitted a sound post 6 within ¼ inches from a leg of the bridge 5 as described above so as not to be excessively strong or weak with respect to the back plate and belly.

If the lower end of the sound post 6 is always in contact with the hard back plate 2, the vibration of the sound post 6 is small, and the vibration of the belly 1 created by the bridge 5 at a position slightly away from the sound post causes intermediate portions 1' and 1'' of the belly 1 on both sides to be vibrated about an upper end 6' of the sound post 6 so as to be webs of the vibration.

In order that the supporting point 6' does not obstruct the vibration of the belly 1, it is obviously desirable that the contact between the supporting point 6' and the belly 1 is point or linear. Linear contact sound posts are shown in FIGS. 2 and 3; point contact sound posts are shown in FIGS. 5 and 6. However, if both the sound post and the belly are formed of soft pine material, the aforesaid contact portion should suffice to be substantially linear in consideration of the durability.

The sound post 6 shown in FIG. 2 is in a form of a round rod made of a pine material having a diameter of several mm and a length of about 5 cm, similar to the conventional sound post as a whole. In the present invention, the opposite ends are molded into a cylindrical shape having an axis perpendicularly intersecting an axis of the sound post, and the base lines 6' and 6'' form ridge lines substantially parallel with the grain.

The ridge line portions are in contact with the inner surfaces of the belly 1 and the back plate 2 of the violin to form substantially straight-line supporting points. By employing the direction of the grain as described, it is possible to prevent the wear of the supporting point and keep the quality of sound for long periods.

In the embodiment shown in FIG. 3, only the upper end of the sound post 6 is converged, and the ridge line portion thereof is in contact with the back surface of the belly 1 on which the grains run lengthwise of the violin to form a substantially straight-line supporting point.

The vibration of the belly is directly restricted by the contact point with respect to the belly. Therefore, the effect substantially similar to that of the first embodiment can be achieved by imparting the linear contact to the upper end.

Especially, a harmonic sound is improved by use of the sound post of the present invention. But depression of vibrations of harmony are sometimes preferable in terms of being balanced with a fundamental vibration.

In such a case, various changes in the design can be made such that a narrow plane portion is left in the contact portion between the extreme end of the sound post and the belly or the back plate, and the contact portion with the belly is formed to have a plane and only the contact portion with the back plate is formed to have a linear contact.

While in the above-described embodiments, the sound post 6 has a shape of a round rod following the shape of the conventional sound post, it is to be noted that the shape of the sound post itself may be of suitable shapes in section such as a flat oval or a square, etc. Further, not only the violin but also musical instruments of a violin family having a similar construction have similar effects. The violin mentioned in the present specification means a violin family.

The violin according to this invention has a simple structure in which a shape of an extreme end of the sound post is merely changed, but the contact portion with the belly or the back plate is made small to thereby not obstruct the vibration thereof. As a result, it seems that not only the volume increases but also an overtone becomes rich. But excellent effects can be obtained as compared with the conventional violin, such that a tone color becomes clear, and particularly in a high-pitched tone, a weak tone is not discontinued.

What is claimed is:

1. An improved violin, the improvement comprising a rod-shaped sound post wherein at least one end of said sound post is formed into a converged configuration having a substantially linear contact surface thereof with a belly or a back plate.

2. An improved violin according to claim 1, wherein the end of the sound post formed to be convergent and having said substantially linear contact surface is an end in contact with the belly.

3. An improved violin according to claim 1, wherein opposite ends of the sound post are formed into a converged configuration so that the contact surface thereof with both the belly and the back plate is substantially linear.

4. An improved violin according to claim 1, wherein at least one end of the sound post is in substantially linear contact with the belly or the back plate, wherein the line of contact is in a direction perpendicular to a direction of a bowstring of the violin.

5. An improved violin according to claim 1, wherein said sound post is solid in cross-section.

6. An improved violin, the improvement comprising a rod-shaped sound post wherein at least one end of said sound post is formed into a converged configuration having a substantially single point contact surface thereof with a belly or a back plate.

7. An improved violin according to claim 6, wherein the end of the sound post formed to be convergent and having said substantially single point contact surface is an end in contact with the belly.

8. An improved violin according to claim 6, wherein opposite ends of the sound post are formed into a converged configuration so that the contact surface thereof with both the belly and the back plate is substantially a single point contact.

9. An improved violin according to claim 6, wherein said sound post is solid in cross-section.

* * * * *

UNITED STATES PATENT AND TRADEMARK OFFICE

CERTIFICATE OF CORRECTION

PATENT NO. : 5,307,721

DATED : 5/3/94

INVENTOR(S) : Ito, Shoichi

It is certified that error appears in the above-indentified patent and that said Letters Patent is hereby corrected as shown below:

Cover page, item [30], change "January 11, 1991" to --November 1, 1991--.

Signed and Sealed this

Thirtieth Day of August, 1994

*Attest:*

Bruce Lehman

BRUCE LEHMAN

*Attesting Officer*

*Commissioner of Patents and Trademarks*